US011638507B2

(12) United States Patent
Williams et al.

(10) Patent No.: US 11,638,507 B2
(45) Date of Patent: May 2, 2023

(54) VACUUM CLEANER

(71) Applicant: TECHTRONIC CORDLESS GP, Anderson, SC (US)

(72) Inventors: Brianna Williams, Greenville, SC (US); Stephen A. Hughett, Anderson, SC (US); Christopher M. Williams, Matthews, NC (US)

(73) Assignee: Techtronic Cordless GP, Anderson, SC (US)

( * ) Notice: Subject to any disclaimer, the term of this patent is extended or adjusted under 35 U.S.C. 154(b) by 611 days.

(21) Appl. No.: 16/582,381

(22) Filed: Sep. 25, 2019

(65) Prior Publication Data

US 2020/0107684 A1 Apr. 9, 2020

Related U.S. Application Data

(60) Provisional application No. 62/741,440, filed on Oct. 4, 2018.

(51) Int. Cl.
*A47L 9/04* (2006.01)
*A47L 11/40* (2006.01)

(52) U.S. Cl.
CPC ..... *A47L 9/0477* (2013.01); *A47L 11/4041* (2013.01); *A47L 11/4044* (2013.01)

(58) Field of Classification Search
CPC ..... A47L 9/0477; A47L 11/4041; A47L 11/4044; A47L 5/30; A47L 9/0466; A46B 13/001
USPC ..... 15/320, 383, 179
See application file for complete search history.

(56) References Cited

U.S. PATENT DOCUMENTS 2,300,267 A 10/1942 Smellie
4,173,807 A * 11/1979 Maier ..... A46B 17/06 15/179
4,307,479 A 12/1981 Mertes et al.
5,056,181 A 10/1991 Tsuchiya et al.
(Continued)

FOREIGN PATENT DOCUMENTS

CN 106419767 A * 2/2017
DE 594234 C * 3/1934
(Continued)

OTHER PUBLICATIONS

Machine translation of DE594234C (Year: 2021).*
(Continued)

*Primary Examiner* — Don M Anderson
*Assistant Examiner* — Sarah Akyaa Fordjour
(74) *Attorney, Agent, or Firm* — Michael Best & Friedrich LLP

(57) ABSTRACT

A vacuum cleaner includes a base and a brushroll positioned within the base. The base has a suction opening and is configured to move along a surface to be cleaned. The brushroll is rotatable relative to the base about an axis, and the brushroll includes a first end, a second end, an inflection point located between the ends, and a material that protrudes radially away from the brushroll. The material extends between the first end and the second end and wraps around the brushroll with a pitch. The material wraps in a first direction between the first end and the inflection point and wraps in a second direction between the inflection point and the second end.

21 Claims, 12 Drawing Sheets

(56) References Cited

U.S. PATENT DOCUMENTS

| | | | | |
|---|---|---|---|---|
| 6,021,545 | A | 2/2000 | Delgado et al. | |
| 6,108,853 | A * | 8/2000 | Dittus | A47L 9/0477 15/179 |
| 6,532,619 | B2 | 3/2003 | Kasper et al. | |
| 6,735,812 | B2 | 5/2004 | Hekman et al. | |
| 6,754,466 | B1 | 6/2004 | Pozniakas | |
| 6,859,976 | B2 | 3/2005 | Plankenhorn | |
| 6,934,993 | B1 | 8/2005 | Huffman et al. | |
| RE39,422 | E | 12/2006 | Clemons | |
| 7,171,723 | B2 | 2/2007 | Kobayashi et al. | |
| 7,251,857 | B2 | 8/2007 | Caruso | |
| 7,257,852 | B2 | 8/2007 | Shibuya et al. | |
| 8,083,860 | B2 | 12/2011 | Loftis | |
| 8,087,117 | B2 * | 1/2012 | Kapoor | A47L 11/4069 15/52.1 |
| 8,265,394 | B2 | 9/2012 | Okazawa | |
| 8,745,818 | B2 | 6/2014 | Iles et al. | |
| 8,806,710 | B2 * | 8/2014 | Follows | A46B 13/02 15/383 |
| 8,914,942 | B2 | 12/2014 | Courtney et al. | |
| 9,066,640 | B2 | 6/2015 | Iles et al. | |
| 9,072,415 | B2 | 7/2015 | Krebs | |
| 9,402,519 | B2 | 8/2016 | Andrikanich et al. | |
| D790,785 | S | 6/2017 | Courtney et al. | |
| 9,706,888 | B2 | 7/2017 | Krebs | |
| 9,770,151 | B2 | 9/2017 | Sun et al. | |
| 9,848,747 | B2 | 12/2017 | Seo | |
| 9,955,832 | B2 * | 5/2018 | Thorne | A47L 5/30 |
| 10,004,370 | B2 | 6/2018 | Isley et al. | |
| 10,092,155 | B2 | 10/2018 | Xia et al. | |
| 2005/0005389 | A1 | 1/2005 | Rau et al. | |
| 2007/0186370 | A1 | 8/2007 | Oh et al. | |
| 2008/0022484 | A1 | 1/2008 | Caruso | |
| 2009/0007368 | A1 | 1/2009 | Oh | |
| 2010/0077820 | A1 | 4/2010 | Porco | |
| 2012/0110779 | A1 | 5/2012 | Jacobson | |
| 2012/0311802 | A1 | 12/2012 | Hinnant | |
| 2013/0139349 | A1 * | 6/2013 | Iles | A47L 9/04 15/383 |
| 2013/0192325 | A1 | 8/2013 | Porco | |
| 2015/0082580 | A1 | 3/2015 | Jacobson | |
| 2015/0183011 | A1 | 7/2015 | Porco | |
| 2016/0174792 | A1 | 6/2016 | Williamson et al. | |
| 2016/0183749 | A1 | 6/2016 | Isley et al. | |
| 2016/0338560 | A1 | 11/2016 | Andrikanich et al. | |
| 2017/0119225 | A1 | 5/2017 | Xia et al. | |
| 2017/0215667 | A1 | 8/2017 | Thorne et al. | |
| 2017/0273522 | A1 | 9/2017 | Krebs | |
| 2017/0340180 | A1 | 11/2017 | Isley et al. | |
| 2017/0360269 | A1 | 12/2017 | Chao | |
| 2018/0098678 | A1 | 4/2018 | Chao | |
| 2018/0110388 | A1 | 4/2018 | Xia et al. | |
| 2018/0255992 | A1 | 9/2018 | Isley et al. | |

FOREIGN PATENT DOCUMENTS

| | | | | |
|---|---|---|---|---|
| DE | 594234 | C | 3/1934 | |
| DE | 1967828 | U | 9/1967 | |
| GB | 1023556 | A * | 3/1966 | A47L 11/4041 |
| GB | 1023556 | A | 3/1966 | |
| JP | 2009268684 | A | 11/2009 | |
| WO | 2012117125 | A1 | 9/2012 | |

OTHER PUBLICATIONS

CN106419767A machine translation (Year: 2022).*
Translation DE594234C (Year: 2022).*
European Patent Office Extended Search Report For Application No. 19201504.8 dated Feb. 6, 2020 (8 pages).

* cited by examiner

VACUUM CLEANER

CROSS-REFERENCE TO RELATED APPLICATIONS

This application claims priority to U.S. Provisional Patent Application No. 62/741,440 filed on Oct. 4, 2018, the entire content of which is incorporated herein by reference.

BACKGROUND

The present subject matter relates to vacuum cleaners and more particularly to brushrolls for vacuum cleaners.

SUMMARY

In one embodiment, a vacuum cleaner includes a base and a brushroll positioned within the base. The base has a suction opening and is configured to move along a surface to be cleaned. The brushroll is rotatable relative to the base about an axis, and the brushroll includes a first end, a second end, an inflection point located along the axis between the first end and the second end, and a first material that protrudes in a radial direction away from the brushroll. The first material, having a first width, extends between the first end and the second end and wraps around the brushroll with a pitch relative to the axis. The first material wraps in a first direction between the first end and the inflection point and wraps in a second direction between the inflection point and the second end. The pitch of the first material that wraps in the first direction is opposite to the pitch of the first material that wraps the second direction.

In another embodiment, a vacuum cleaner includes a base and a brushroll positioned within the base. The base has a suction opening and is configured to move along a surface to be cleaned. The brushroll is rotatable relative to the base about an axis, and the brushroll includes a body, a first end, a second end, an inflection point located along the axis between the first end and the second end, a wall that extends in a radial direction away from the body, and grooves along the wall. The wall follows a sloped path around the brushroll between the first end and the second end and wraps around the brushroll about the axis. The direction of the sloped path around the body reverses at the inflection point. The grooves along the wall extend along a length of the brushroll between the first end and the second end and are spaced around a circumference of the brushroll.

In yet another embodiment, a vacuum cleaner includes a base, a brushroll that is removable from and insertable into the base, and an aperture though which the brushroll is removed and inserted. The base has a suction opening and is configured to move along a surface to be cleaned. The brushroll is rotatable relative to the base about an axis, and the brushroll includes a body, a first end, and a second end. The aperture includes teeth that are spaced around a circumference of the aperture. The teeth protrude parallel with axis and away from the aperture towards the brushroll. The teeth of the aperture align with the body of the brushroll to collect debris from the brushroll as the brushroll is being removed from the base through the aperture.

Other aspects of the present subject matter will become apparent by consideration of the detailed description and accompanying drawings.

Before any embodiments of the present subject matter are explained in detail, it is to be understood that the present subject matter is not limited in its application to the details of construction and the arrangement of components set forth in the following description or illustrated in the following drawings. The present subject matter is capable of other embodiments and of being practiced or of being carried out in various ways.

DETAILED DESCRIPTION

Figure 1:
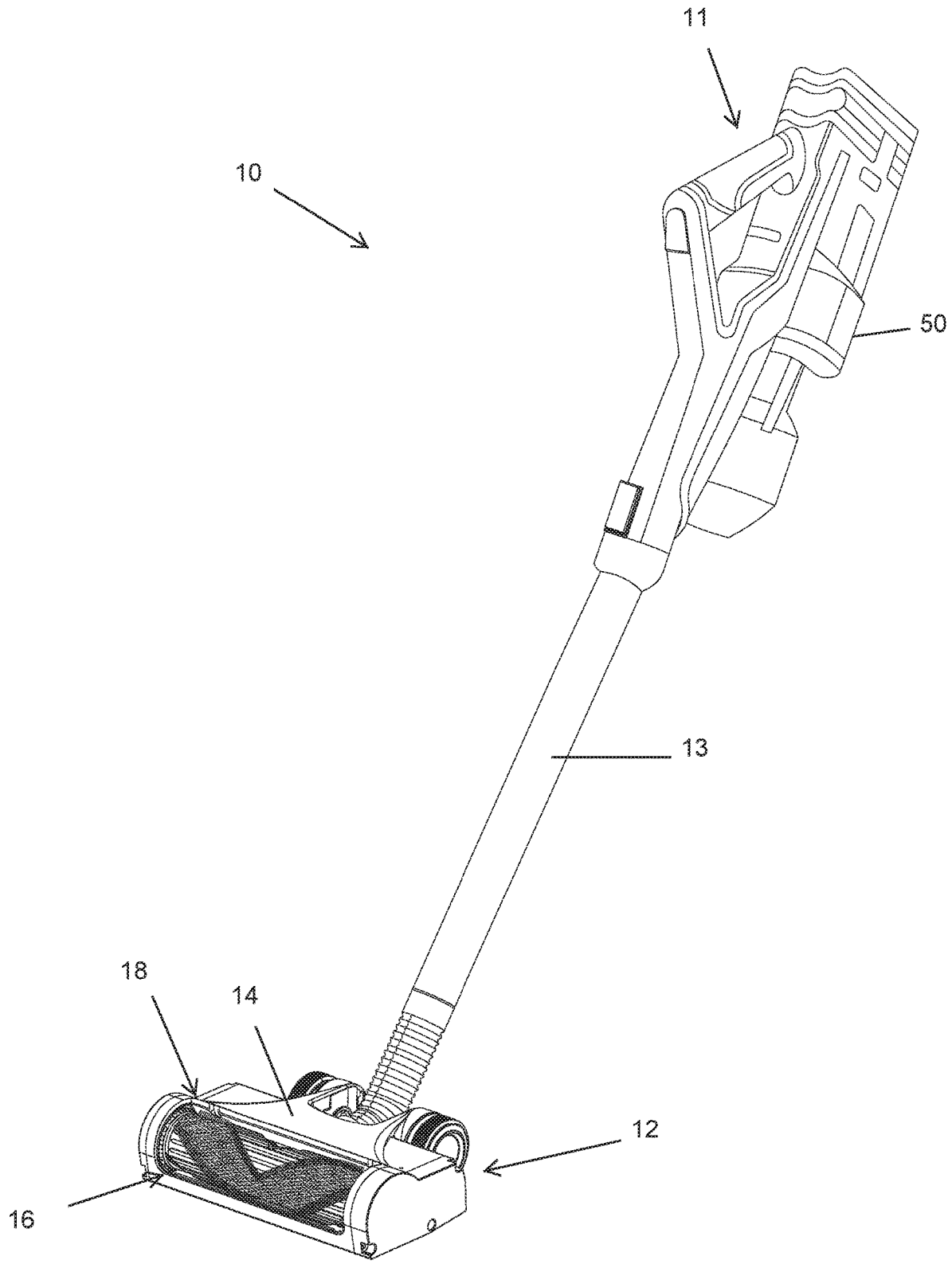
FIG. 1 is a perspective view of a vacuum cleaner according to an embodiment of the present disclosure.

FIG. 1 illustrates a vacuum cleaner 10 according to an embodiment of the present disclosure. The vacuum cleaner 10 includes a handle 11, a floor nozzle or base 12, and a shaft 13 for connecting the handle 11 to the base 12. The base 12 includes a housing 14 and a brushroll or beater bar 16 that rotates relative to the base 12 about an axis 17 (FIG. 2) that extends along a length of the brushroll 16 and through a center of the brushroll 16. In the illustrated embodiment, the base 12 includes a window 18 that allows the user to view the brushroll 16 within the base 12. The window 18 may be transparent, or semi-transparent, in some cases.

Figure 2:
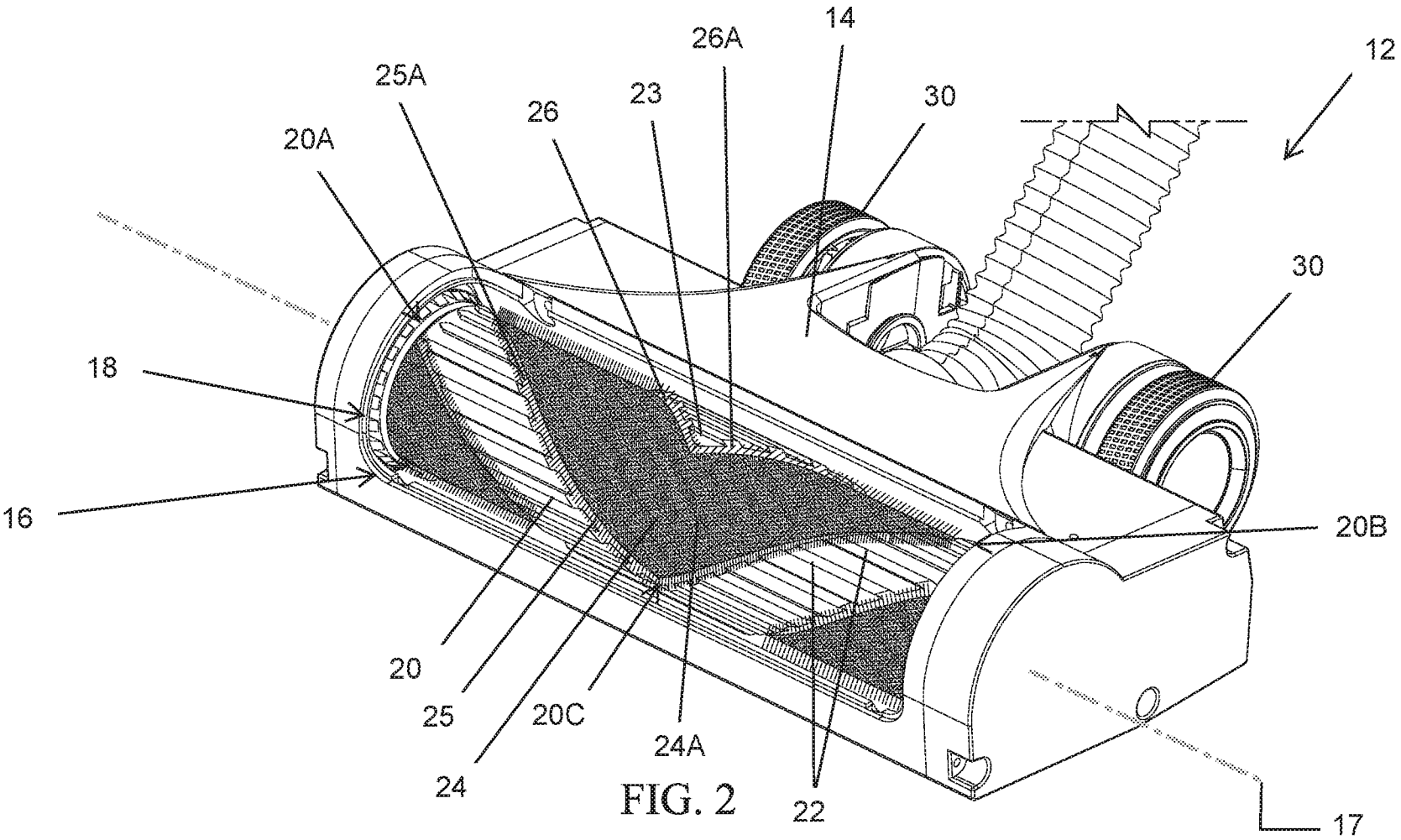
FIG. 2 is a perspective view of a base of the vacuum cleaner of FIG. 1.
Figure 12:
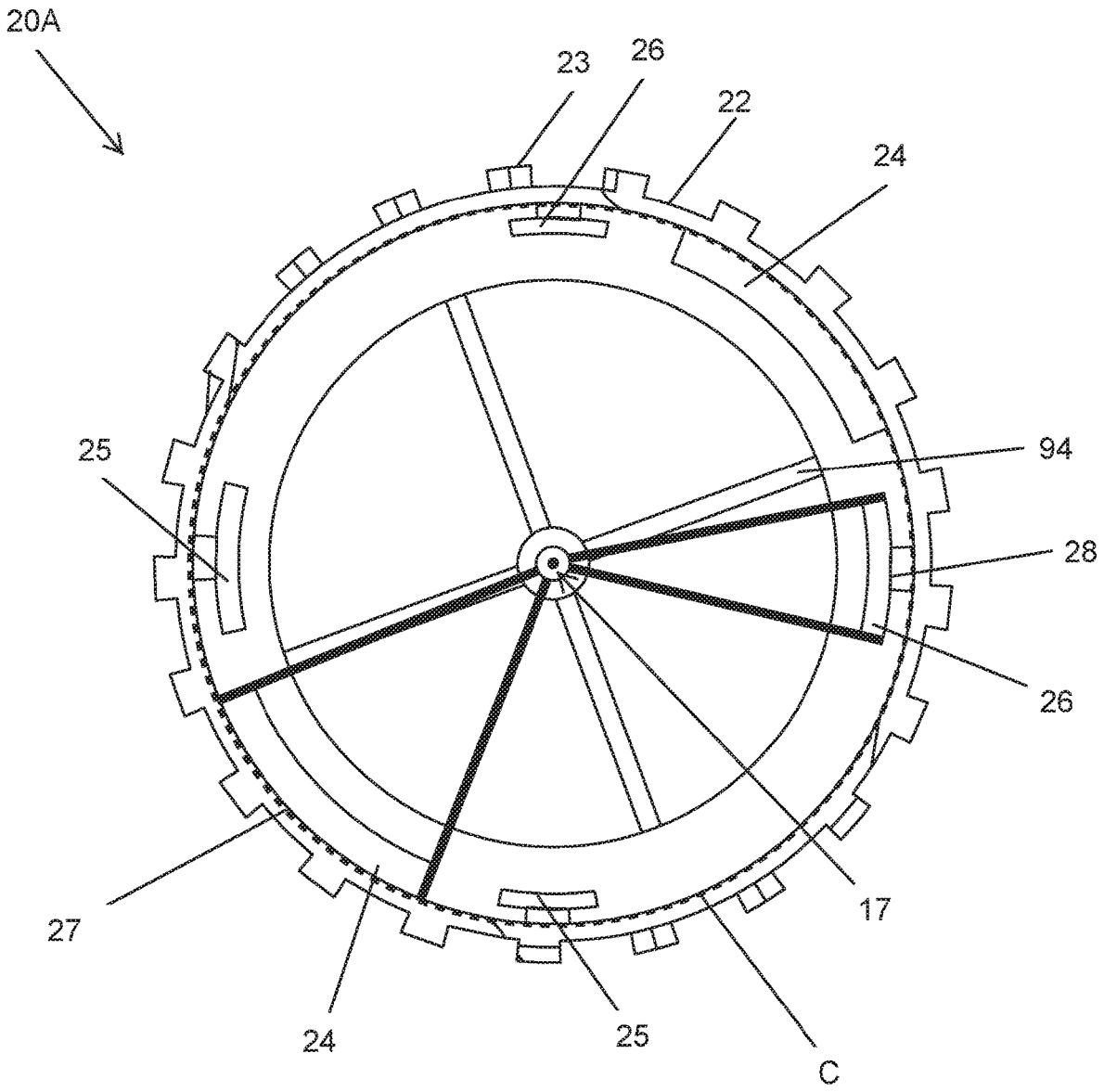
FIG. 12 is a left-side view of the brushroll.
Figure 13:
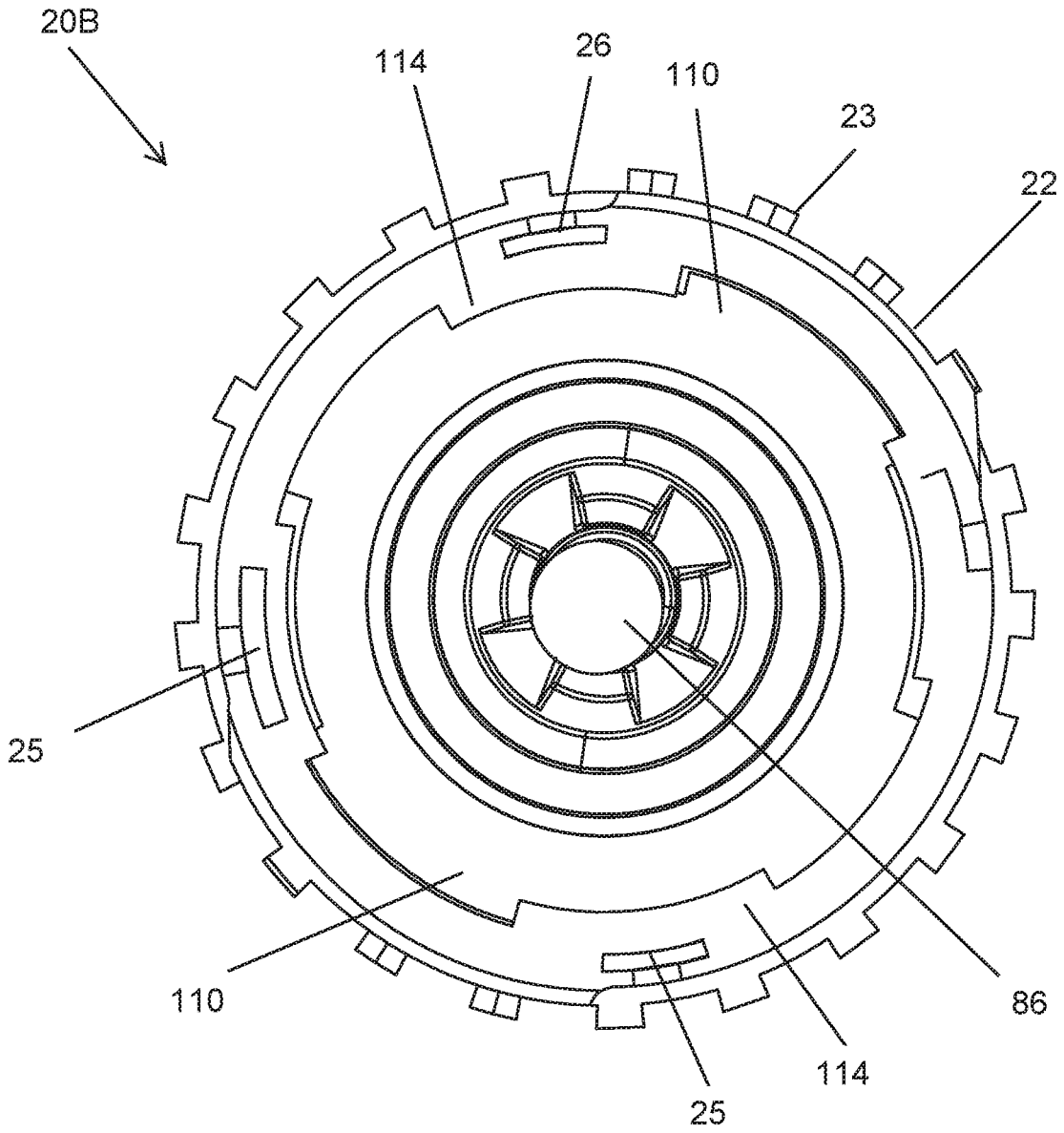
FIG. 13 is a right-side view of the brushroll and a portion of the base.
Figure 14:
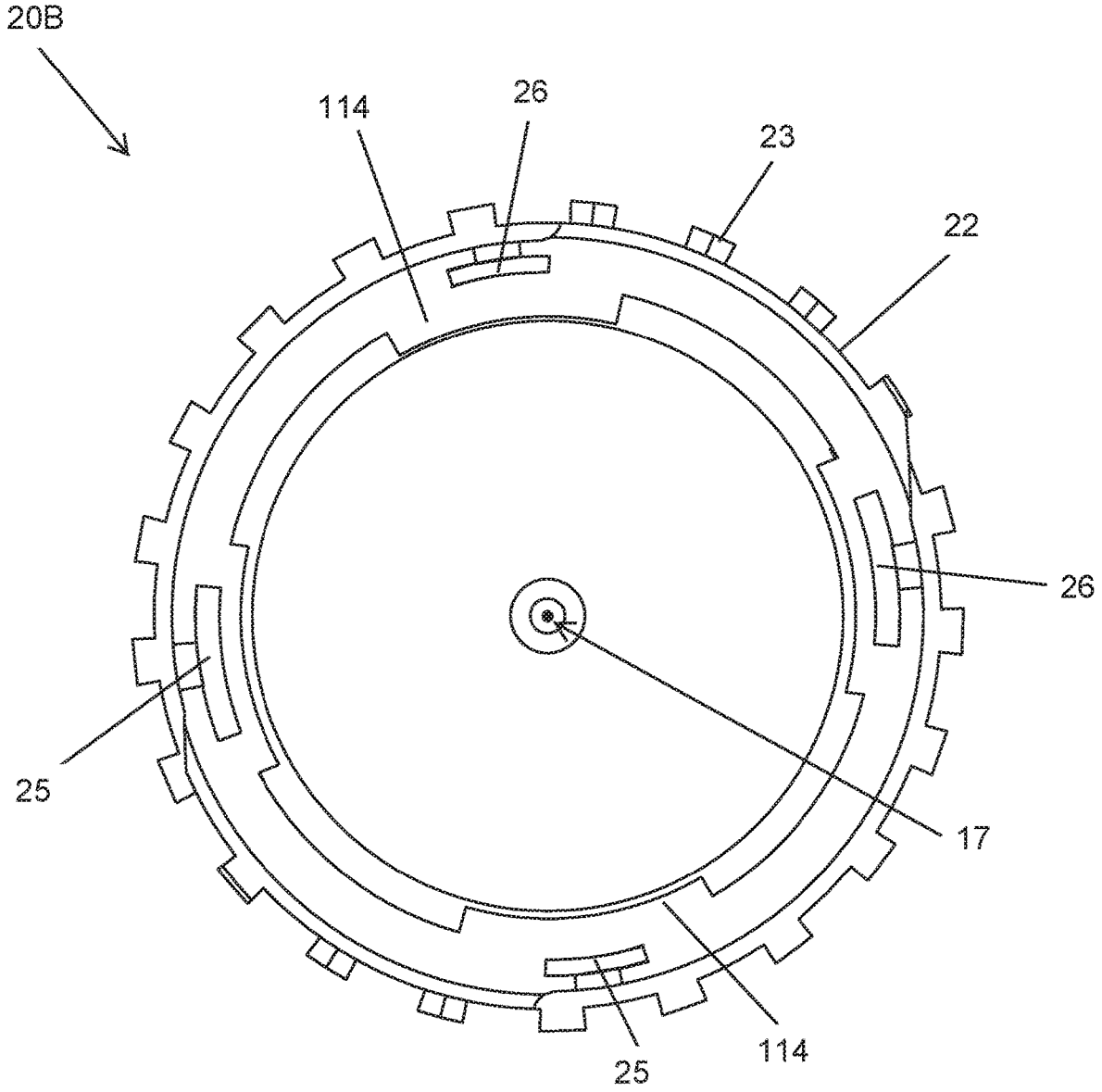
FIG. 14 is a right-side view of the brushroll.

Referring to FIG. 2, the brushroll 16 includes a body 20 that has a first end 20A, a second end 20B, and an inflection point 20C substantially in the middle of the first end 20A and the second end 20B. The details of the inflection point 20C are described further below. The body 20 may be formed, at least partially, from a rubber or plastic material in some embodiments. The body 20 may include a plurality of grooves 22, a wall 23, a first recess 24 for receiving a first cleaning material 24A, a second recess 25 for receiving a second cleaning material 25A, and a third recess 26 for receiving a third cleaning material 26A. As used herein, the term cleaning material refers to materials configured for cleaning, such as, for example, a textile (e.g., woven, non-woven materials) configured for cleaning, a specific fabric configured for cleaning, a bristle configured for cleaning, a foam material configured for cleaning, an electrostatic material configured for cleaning, and/or the like. The grooves 22 may extend into the wall 23 along the length of the body 20 between the first end 20A and the second end 20B. The brushroll 16 additionally comprises a circumference C (FIG. 12) and the grooves 22 may be spaced evenly around the circumference C. Unevenly spaced grooves 22 are also contemplated. In some embodiments, the first, second and third recess 24, 25, 26 all receive a first type (i.e., a same type) of material. In the illustrated embodiment, the first recess 24 receives the first material 24A, and the second and third recesses 25, 26 receive the second material 25A. In yet another embodiment, the first, second, and third cleaning materials 24A, 25A, and 26A are received and/or attached directly on the body 20 of the brushroll 16 and connected with a fastener (e.g., a glue, an adhesive, a hook and loop fastener, and/or the like).

Figure 8:
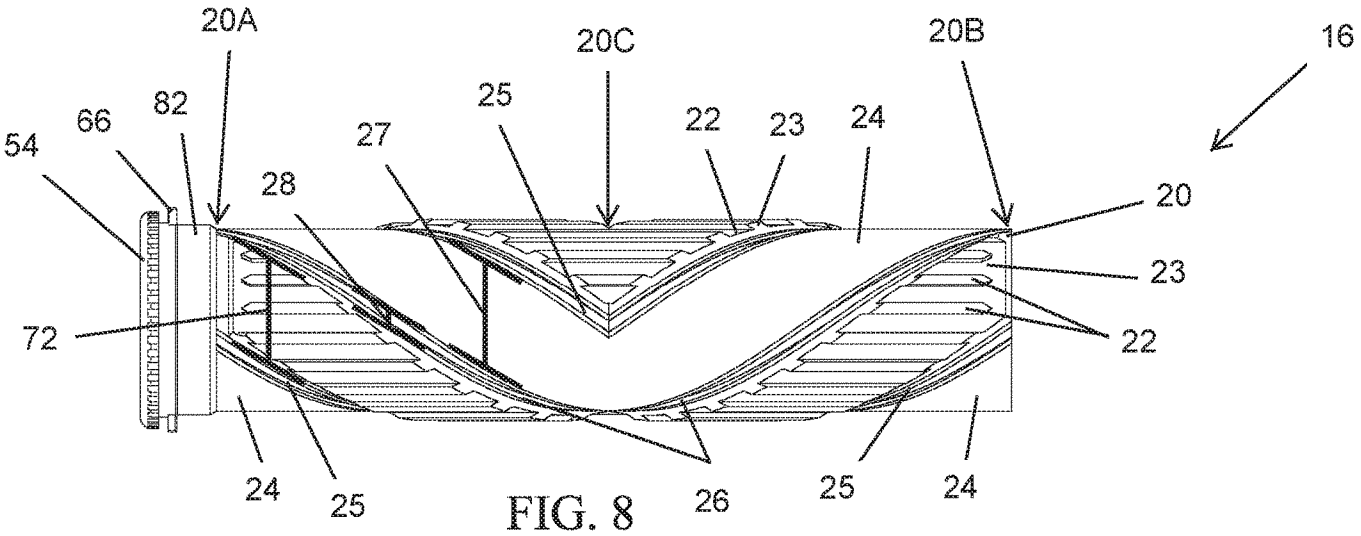
FIG. 8 is a top view of the brushroll of FIG. 5.

With continued reference to FIG. 2, the first recess 24 has a first width 27 (FIG. 8) and follows a V-shaped path that extends or wraps around the circumference C of the body 20. The second and third recesses 25, 26 each have a second width 28 (FIG. 8). The first width 27 (see, e.g., FIGS. 8 and 12) is a length of an arc extending between a top and bottom of the first recess 24 along a line normal to the axis 17. The second width 28 (shown in FIGS. 8 and 12) is a length of an arc extending between a top and bottom of the second and/or third recesses 25 and 26 along a line normal to the axis 17. The second width 28 may be relatively narrow compared to the relatively wide first width 27. The second and third recesses 25, 26 may be located on opposite sides of the first recess 24. The first recess 24 may be disposed between the second recess 24 and third recess 26 and each of the recesses 24, 25, 26 may follow and/or be formed as a V-shaped path.

In the illustrated embodiment, the path of the first material 24A may be substantially the same as the path of the first recess 24, the path of the second material 25A may be substantially the same as the path of the second recess 25, and the path of the third material 26A may be substantially the same as the path of the third recess 26. In another embodiment, the first, second and third material 24A, 25A, 26A may be received directly on the body 20 of the brushroll 16 and connected with a fastener rather than received in a first, second, or third recesses 24, 25, 26, respectively.

Figure 3:
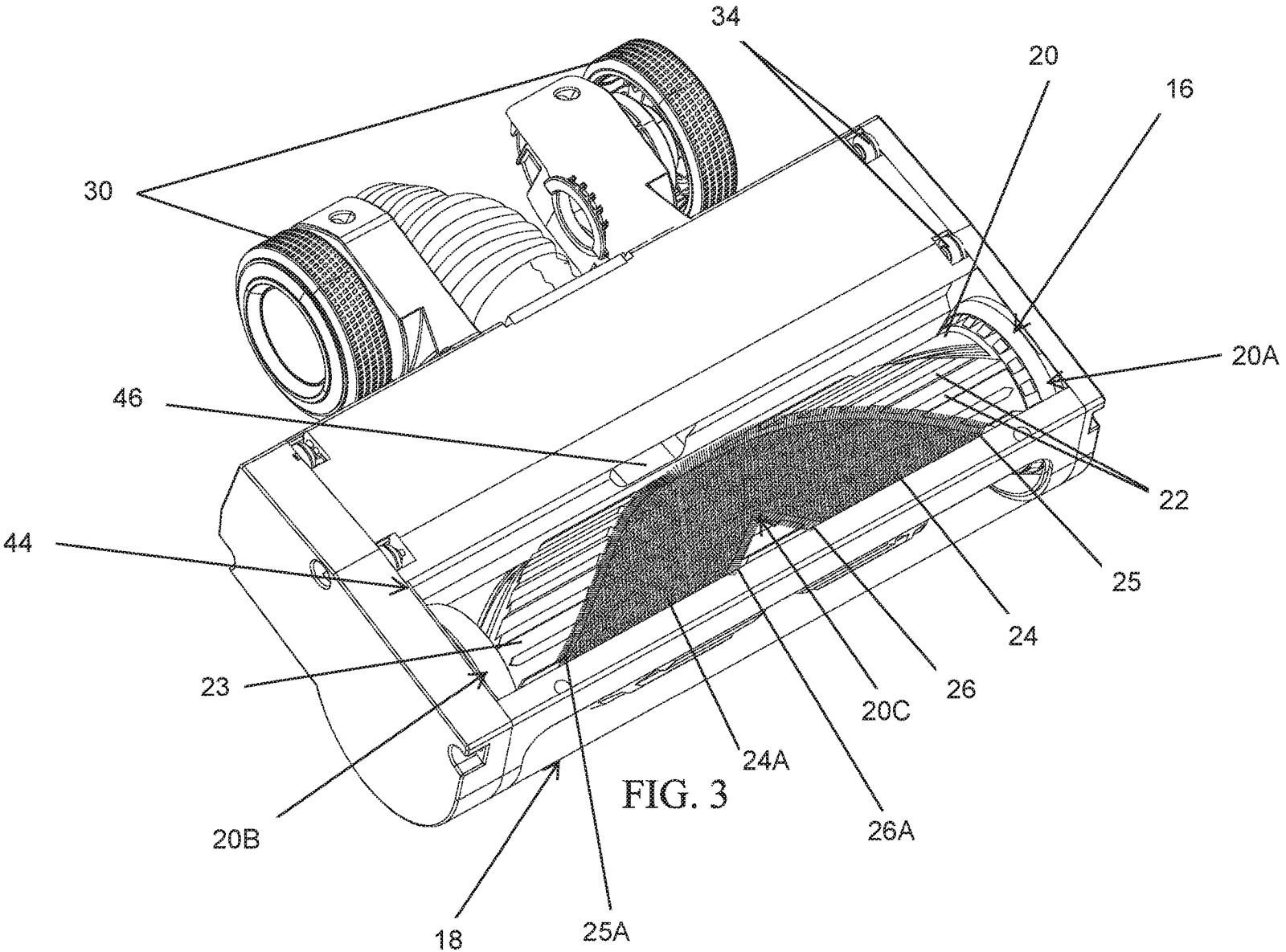
FIG. 3 is a bottom perspective view of the base of FIG. 2.
Figure 4:
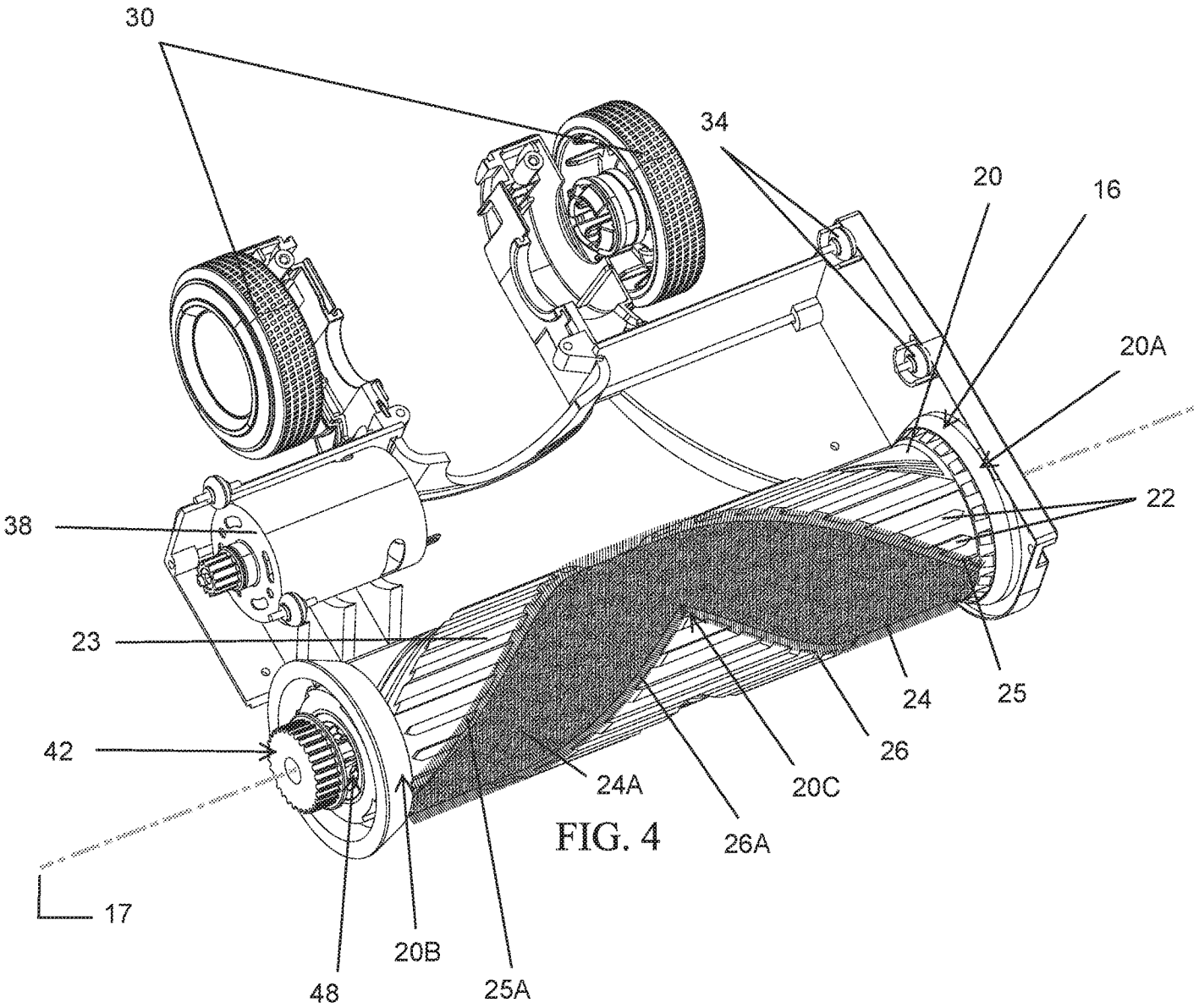
FIG. 4 is a bottom perspective view of the base illustrating inner components of the base.

Referring now to FIGS. 2-4 of the illustrated embodiment, the first material 24A may be formed from a plush cloth material. Other materials (e.g. non-plush materials) may also be used as the first material 24A in some embodiments. The second material 25A may include and/or be formed as a row of bristles. The third material 26A may include a row of bristles. The second and third materials 25A and 26A may include different types of bristles (e.g., bristles having different lengths, diameters, and/or the like) and/or bristles comprised of different materials. In one embodiment, the bristles may include and/or be formed as nylon bristles. The first material 24A may include a first length and is configured for collecting a first type of debris (e.g., dirt, dust, powder, glitter, particulates, and/or the like). The second and third material 25A, 26A may have a second length that is greater than the first length and are configured for collecting a second type of debris (e.g., hair, hay, thread, string, and/or the like).

The details regarding the inflection point 20C will now be described with reference to the V-shaped path. In some embodiments, the inflection point 20C lies along the axis 17 and is about equidistant between the first end 20A and the second end 20B. The first material 24A protrudes in a radial direction away from the brushroll 16 and extends between the first end 20A and the second end 20B. The path of the first material 24A wraps around the brushroll 16 with a pitch P (FIG. 9) relative to the axis 17. Between the first end 20A and the inflection point 20C, the path of the first material 24A wraps in a first direction (i.e., clockwise). Between the inflection point 20C and the second end 20B, the path of the first material 24A wraps in a second direction (i.e., counter-clockwise). At the inflection point 20C, the pitch P of the path of first material 24A wrapping in the clockwise direction flips such that the pitch P of the path of first material 24A wrapping in the counter-clockwise direction is equal and opposite, or substantially equal and opposite.

In the illustrated embodiment, the V-shaped path extends between the first end 20A and the second end 20B, and the inflection point 20C represents the tip of the letter "V" where the V-shaped path changes direction. The first, second, and third recesses 24, 25, 26 and the first, second, and/or third materials 24A, 25A, 26A disposed in the recesses may each follow the V-shaped path as described in the illustrated embodiment. In the illustrated embodiment, each of the first, second, and third recesses 24, 25, 26 are duplicated at least once around the brushroll 16. In another embodiment, the first, second, and third recess 24, 25, 26 are duplicated multiple times around the brushroll 16.

The illustrated brushroll 16 further includes the wall 23 which extends in a radial direction away from the body 20 and follows a sloped path around the brushroll 16. The wall 23 extends between the first end 20A and the second end 20B and wraps around the brushroll 16 about the axis 17. The direction of the sloped path about the axis 17 reverses at the inflection point 20C. The sloped path of the wall 23 substantially follows the path of the first material 24A around the brushroll 16. The sloped path has the pitch P angle that remains constant as the wall 23 wraps clockwise around the brushroll 16 between the first end 20A and the inflection point 20C. At the inflection point 20C, the pitch P angle changes by about 90 degrees relative to the axis 17. As the wall 23 wraps counter clockwise around the brushroll 16 between the inflection point 20C and the second end 20B, the pitch P angle remains constant. The wall 23 between the first end 20A and the inflection point 20C is substantially the same as the wall 23 between the inflection point 20C and the second end 20B when mirrored across the inflection point 20C along the axis 17. In the illustrated embodiment, an entire outer surface of the body 20 is covered by the first material 24A, second material 25A, third material 26A and the wall 23. Meaning that when the materials 24A, 25A, 26A are received on the brushroll 16, none of the outer surface of the body is exposed. In another embodiment, some of the body 20 (e.g., a portion of the body 20) is exposed or uncovered. In yet another embodiment, the entire outer surface of the body 20 is covered by only the first material 24A and the wall 23.

Figure 9:
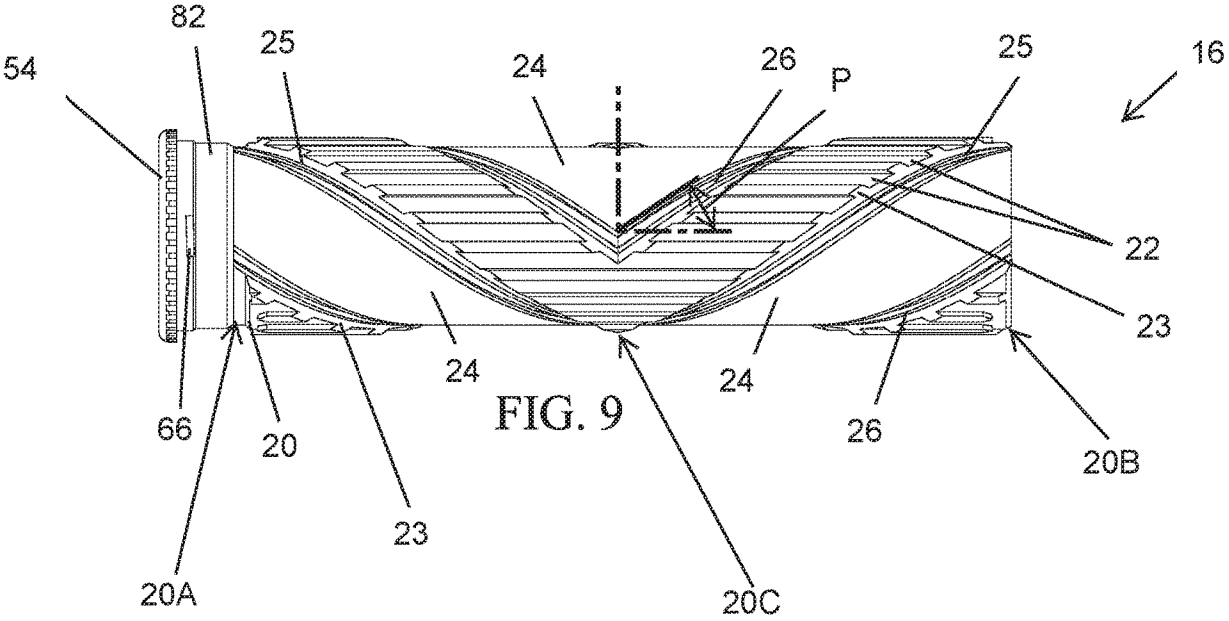
FIG. 9 is a front view of the brushroll of FIG. 5.
Figure 10:
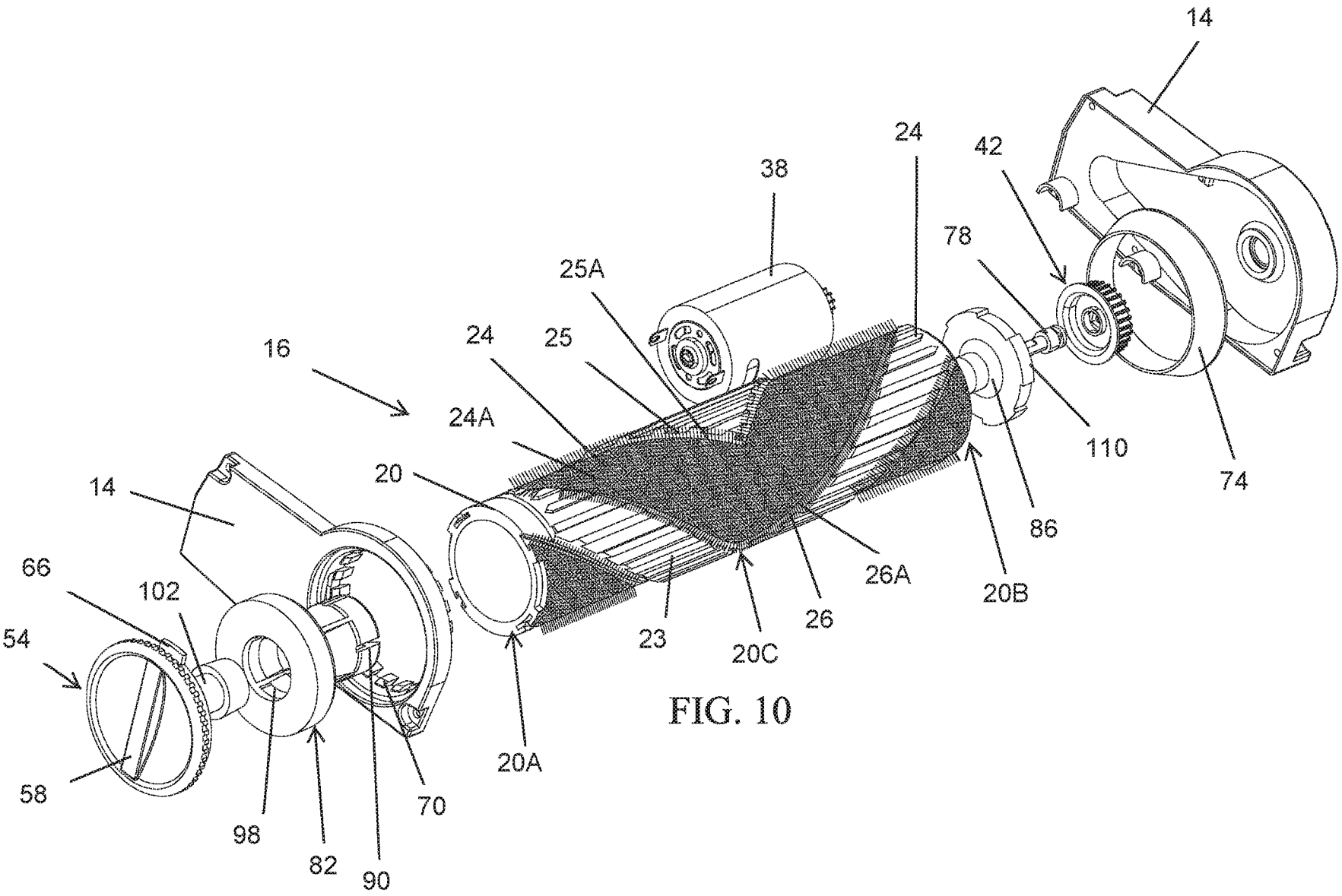
FIG. 10 is an exploded perspective view of the brushroll and a portion of the base.
Figure 11:
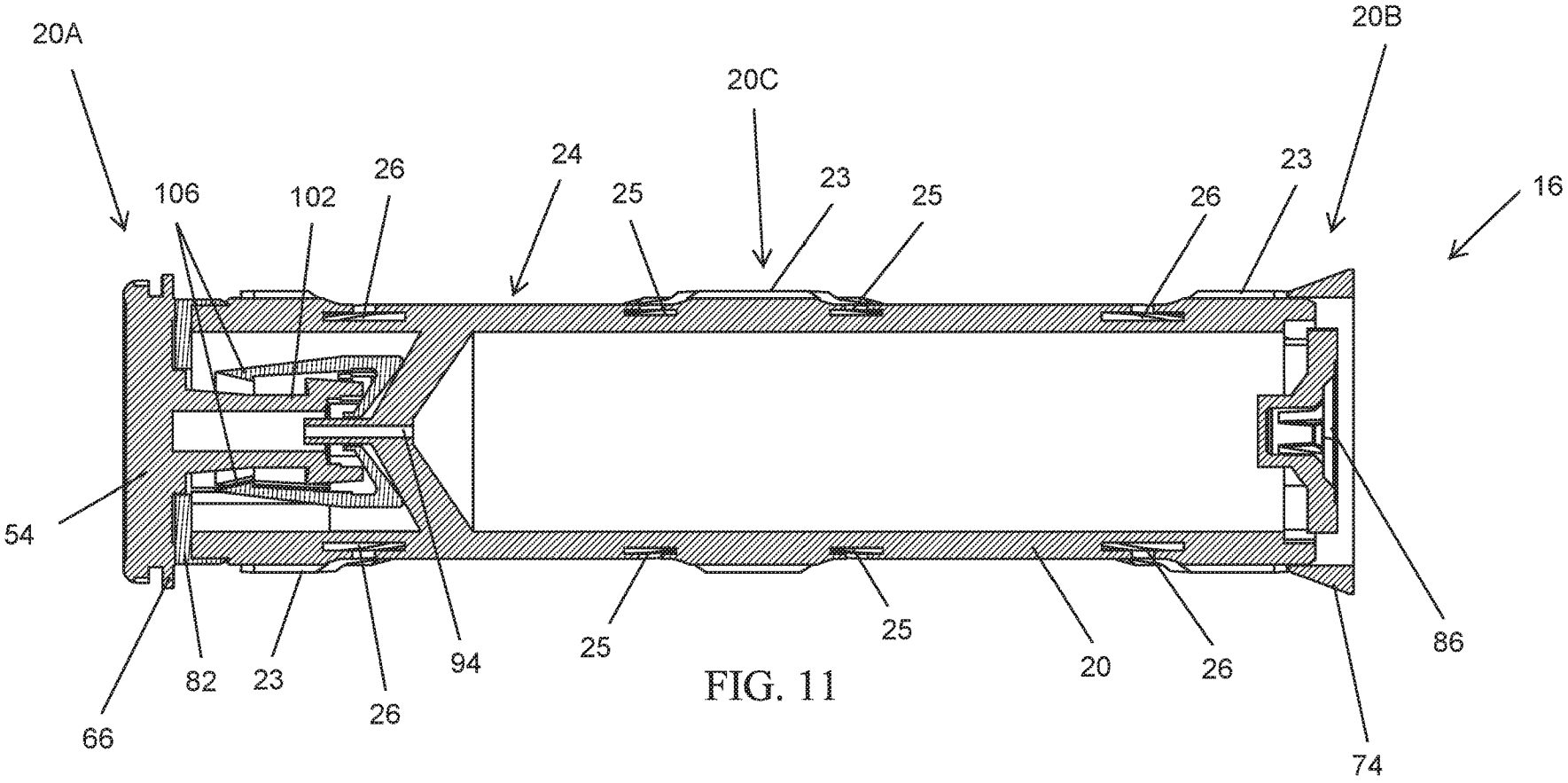
FIG. 11 is a cross-sectional view of the brushroll and a portion of the base taken through the center of the brushroll.

FIGS. 8 and 9 illustrate the brushroll 16 with the first, second, and third material 24A, 25A, 26A removed from the brushroll 16 to reveal the body 20, grooves 22, wall 23 and the first, second, and third recess 24, 25, 26. FIGS. 8 and 9 illustrate the wall 23 and the first, second, and third recesses 24, 25, 26 each following substantially the same V-shaped path. The wall 23 starts at one point of, on, or around the circumference C of the brushroll 16 and the first recess 24 starts at a different point of, on, or around the circumference C of the brushroll 16. A third width 72 (shown in FIGS. 8 and 12) is a width of the wall 23. The third width 72 is an arc having a length between a top and bottom of the wall 23 along a line normal to the axis 17. The first width 27, second width 28 and third width 72 may each remain substantially consistent regardless of where the width is being measured along the axis 17, in some embodiments.

Referring now to FIGS. 3 and 4, the base 12 may additionally include wheels 30, support rollers 34, a motor 38, a driving mechanism 42, a suction opening 44, a suction inlet 46 and roller support assembly 48. The wheels 30 and the support rollers 34 enable the base 12 to be moved along a surface to be cleaned. The handle 11 of FIG. 1 includes a power source 50 operable to generate a suction airflow through the vacuum cleaner 10. The suction airflow is brought in to the base 12 through the suction opening 44 and enters the vacuum cleaner 10 through the suction inlet 46. In another embodiment the power source 50 is located in the base 12. With specific reference to FIG. 4 of the illustrated embodiment, the motor 38 rotates the drive mechanism 42 for rotating the brushroll 16.

Figure 5:
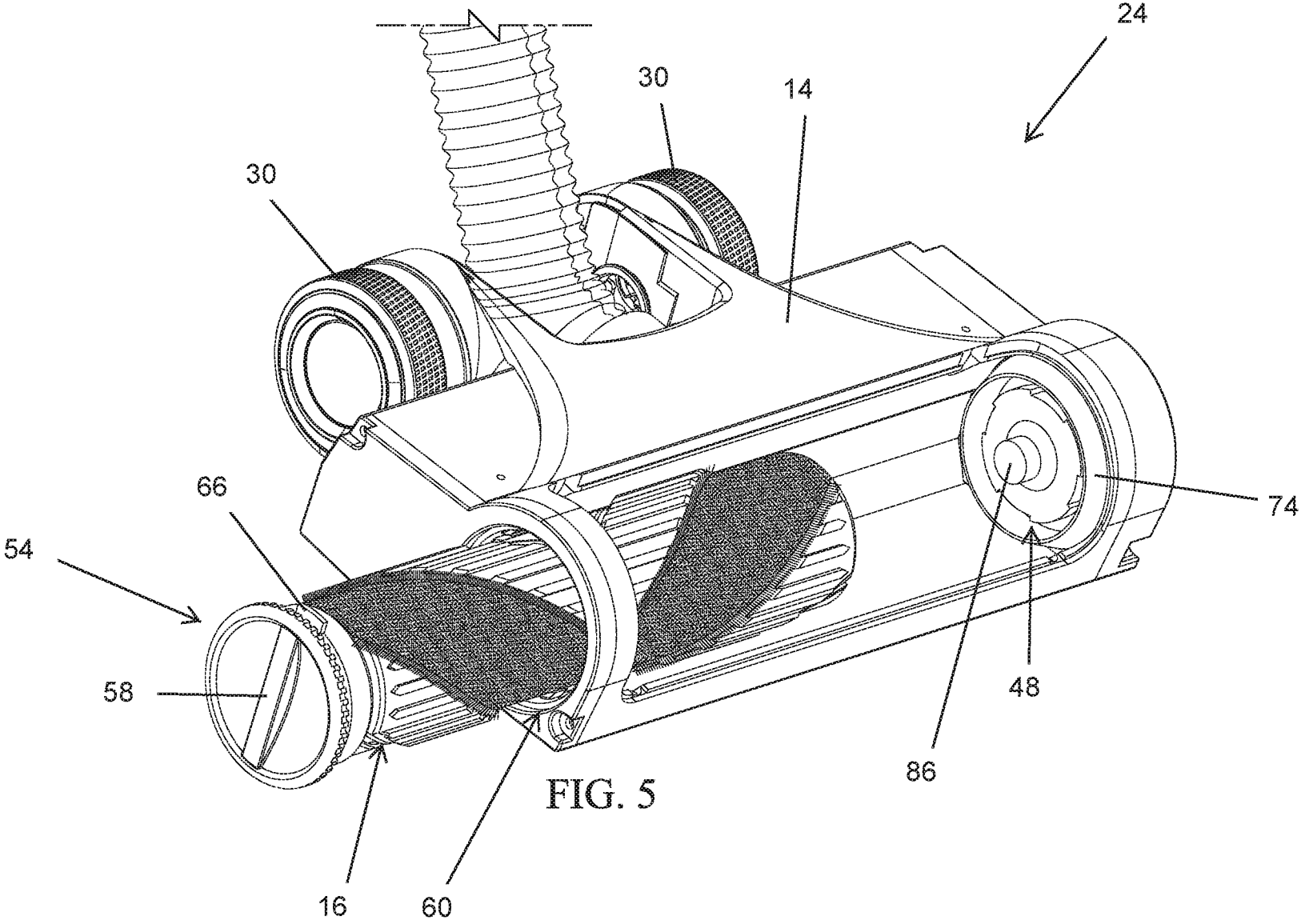
FIG. 5 is a perspective view of the base illustrating a brushroll partially removed from the base.
Figure 7:
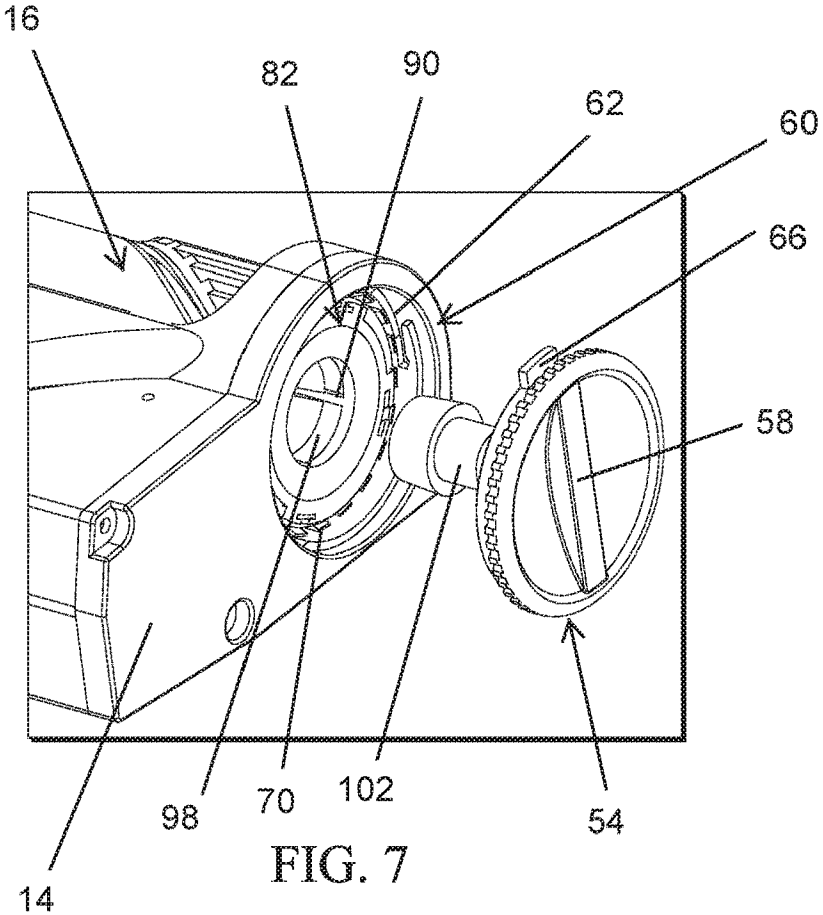
FIG. 7 is a rear perspective view of a portion of the base illustrating the cap of FIG. 6.
Figure 6:
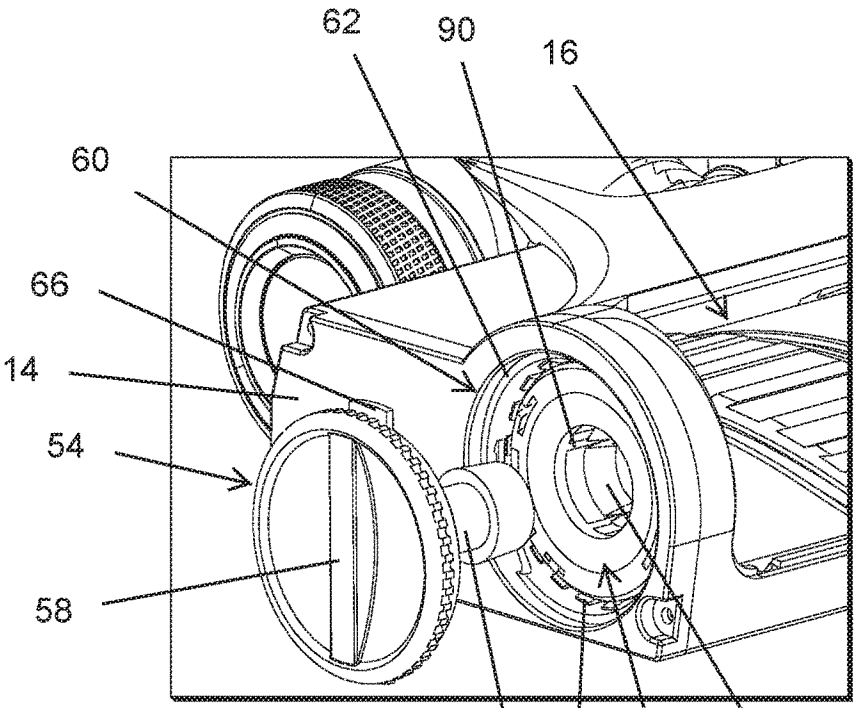
FIG. 6 is a front perspective view of a portion of the base illustrating a cap removable from the base.

With reference to FIGS. 5-7, the base 12 of the illustrated embodiment further includes a cap or cover 54. The cover 54 may be removably attached to the housing 14. The cover 54 includes a cover handle 58 that can be grabbed by a user using their thumb and index finger in one method of operation. In one embodiment, the cover 54 may be rotated (e.g. about one-quarter turn) relative to the housing 14 by the user to release or unlock the cover 54. This allows the user to pull the cover 54 away from the base 14 to access and remove the brushroll 16. FIGS. 6 and 7 illustrate the housing 14 further including an aperture 60 and a radial groove 62 and the cap 54 including a tab 66. The tab 66 corresponds to the radial groove 62 for interlocking the cap 54 to the housing 14 and thereby securing the brushroll 12 in the housing 14.

With continued reference to FIGS. 6 and 7, the aperture 60 may be substantially circular and include teeth 70 that are spaced circumferentially around the aperture 70. The teeth 70 may protrude away from the aperture in a direction toward the second end 20B of the brushroll 16 and parallel to the axis 17. The teeth 70 are configured to align with the spacing of the grooves 22 along the brushroll 16 to collect debris (e.g., hair, dirt, dust, and/or the like) as the brushroll 16 is being removed from the base 12 through the aperture 60. In another embodiment, the teeth 70 need not align with the grooves 22 to collect debris. In yet another embodiment, the body 20 may not include the grooves 22 and the teeth 70 still collect debris. The teeth 70 each have a similar size and shape that correspond with a similar size and shape of the grooves 22. In the illustrated embodiment, the teeth 70 also collect debris as the brushroll 16 is being used. The teeth 70 are also configured to collect elongated debris that would otherwise be missed by the brushroll 16. In this way, the brushroll 16 may be more easily cleaned and/or maintained. The grooves 22 also provide a guide or path for a knife, scissors or other cutting instrument to glide over and remove hair or other debris. The user can move the cutting instrument along the grooves 22 while the grooves 22 guide the movement to cut or otherwise loosen any debris, including hair, which is wrapped around or on the brushroll 16.

In some embodiments, the cover 54 is attached to the brushroll 16 so that the cover 54 may be pulled to pull the brushroll 16 through the aperture 60. That is, the brushroll 16 may be removed along with the cover 54. In such an embodiment, the cover 54 may be rotatable within the aperture 60 relative to the brushroll 16 to align with the radial groove 62 to lock and unlock the cover 54 from the housing 14.

Referring now to FIGS. 10-14 of the illustrated embodiment, the base 12 further includes an end cap 74 located at the second end 20B of the brushroll 16. The end cap 74 may be chamfered or angled toward the brushroll 16 and covers bearing 78 that facilitates rotation of the brushroll 16. The angled or chamfered end cap 74 has been found to minimize the amount of hair and other debris that interferes with rotation of the brushroll 16 and the bearing 78.

The housing 14 may additionally include a plug 82, and a gear 86. The plug 82 includes slots 90 that engage with internal blades 94 of the brushroll 16 such that the plug 82 rotates with the brushroll 16. In the illustrated embodiment, the plug 82 further includes a circular opening 98 for receiving a shaft 102 connected to the cover 54 and the circular opening 98 includes a stopper 106 for preventing the cap 54 from being removed from the plug 82. In another embodiment, the cover 54 may be separated from the plug 82. In still another embodiment, the plug 82 is fixed to the brushroll 16 and the cover 54 is fixed to the plug.

The gear 86 includes gear teeth 110 that engage with roller teeth 114 on the inside of the brushroll 16. The gear 86 is driven by the driving mechanism 42 which rotates the gear teeth 110 to engage the roller teeth 114 to rotate the brushroll 16 relative to the base 12.

Although the present subject matter has been described in detail with reference to certain preferred embodiments, variations and modifications exist within the scope of one or more independent aspects of the subject matter as described.

What is claimed is:

1. A vacuum cleaner comprising:

a base having a suction opening, the base being configured to move along a surface to be cleaned; and a brushroll positioned within the base, the brushroll being rotatable relative to the base about an axis, and the brushroll including:

a first end;

a second end;

an inflection point located along the axis between the first end and the second end; and a first material protruding radially away from the brushroll and having a first width, the first material extending between the first end and the second end, the first material wrapping around the brushroll with a pitch relative to the axis, and the first material wrapping in a first direction between the first end and the inflection point and wrapping in a second direction between the inflection point and the second end, wherein the pitch of the first material wrapping in the first direction is opposite to the pitch of the first material wrapping the second direction, wherein the first material is a plush cloth, and a second material protruding radially away from the brushroll, the second material including a first plurality of bristles and a second plurality of bristles located on opposing sides of the first material, respectively, such that the first material fills a space between the first and second plurality of bristles.

2. The vacuum cleaner of claim 1, wherein the inflection point is about equidistant between the first end and the second end.

3. The vacuum cleaner of claim 1, wherein the first material is received in a first recess, the first material has a first length configured for collecting a first type of debris from the surface to be cleaned.

4. The vacuum cleaner of claim 3, wherein the second material has a second width less than the first width, the second material received in a second recess and a third recess such that the first recess is between the second recess and third recess.

5. The vacuum cleaner of claim 4, wherein the second material has a second length greater than the first length configured for collecting a second type of debris from the surface to be cleaned.

6. The vacuum cleaner of claim 4, wherein the first recess has a "v" shaped path wrapped around the brushroll such that the "v" shaped path extends between the first and second end and the inflection point corresponds to a tip of the letter "v" where the path changes directions.

7. The vacuum cleaner of claim 6, wherein the second recess and third recess follow the "v" shaped path.

8. The vacuum cleaner of claim 7, wherein the pitch of the first recess relative to the axis remains constant as the first recess wraps clockwise around the brushroll between the first end and the inflection point, and at the inflection point the pitch of the first recess relative to the axis changes direction and remains constant as the first recess wraps counter-clockwise around the brushroll between the inflection point and the second end.

9. The vacuum cleaner of claim 6, wherein the brushroll further comprises a wall extending radially away from the brushroll, the wall having the "v" shaped path and adjacent to the first recess such that an entire area of an outer diameter of the brushroll is covered by the wall and the first and second material.

10. A vacuum cleaner comprising:

a base having a suction opening, the base being configured to move along a surface to be cleaned; and a brushroll within the base rotatable relative to the base about an axis, the brushroll including:

a body;

a first end;

a second end;

an inflection point disposed along the axis between the first end and the second end;

a wall extending radially away from the body, the wall following a sloped path around the brushroll between the first end and the second end, and the wall wrapping around the brushroll about the axis, wherein a direction of the sloped path around the brushroll reverses at the inflection point; and grooves along the wall extending axially along a length of the brushroll between the first end and the second end, each of the grooves having a length, wherein the grooves are spaced around a circumference of the brushroll, and wherein the length of at least some of the grooves decreases as the sloped path approaches the inflection point.

11. The vacuum cleaner of claim 10, wherein the inflection point is about equidistant between the first end and the second end.

12. The vacuum cleaner of claim 10, wherein the brushroll supports a first cleaning material configured to collect a first type of debris from the surface to be cleaned and a second cleaning material configured to collect a second type of debris from the surface to be cleaned.

13. The vacuum cleaner of claim 12, wherein the first cleaning material is received in a wide first recess following the sloped path of the wall, and wherein the second cleaning material is received in a narrow second and third recess following the sloped path of the wall such that the wide first recess is between the narrow second and third recess.

14. The vacuum cleaner of claim 12, wherein the sloped path is a "v" shaped path wrapped around the brushroll such that the "v" shaped path extends between the first and second end and the inflection point corresponds to a tip of the letter "v" where the path changes directions.

15. The vacuum cleaner of claim 14, wherein the sloped path of the wall has a pitch angle relative to the axis, the pitch angle remains constant as the wall wraps clockwise around the brushroll between the first end and the inflection point, at the inflection point the pitch angle changes by about 90 degrees relative to the axis, and as the wall wraps counter-clockwise around the brushroll between the inflection point and the second end the pitch angle remains constant.

16. The vacuum cleaner of claim 15, wherein the sloped path of the wall between the first end and the inflection point mirrored across the inflection point nearly equals the sloped path of the wall between the inflection point and the second end.

17. The vacuum cleaner of claim 10, wherein the grooves extend inwardly on the wall toward the center of the brushroll and the grooves are spaced equally around an entire circumference the brushroll.

18. The vacuum cleaner of claim 14, wherein the first and second cleaning material follow the "v" shaped path and are adjacent to the wall such that an entire area of an outer diameter of the brushroll is covered by the wall and the first and second cleaning material.

19. A vacuum cleaner comprising:

a base having a suction opening, the base being configured to move along a surface to be cleaned;

a brushroll removable from and insertable into the base and rotatable about an axis, the brushroll including:

a body;

a first end;

a second end;

the base having an aperture through which the brushroll is removed, the aperture including teeth spaced around a circumference of the aperture, the teeth protruding parallel with the axis and away from the aperture towards the brushroll and for aligning with the body, and the teeth being configured to collect debris from the brushroll as the brushroll is being removed from the base through the aperture.

20. The vacuum cleaner of claim 19, wherein the brushroll further includes grooves extending in parallel with the axis along the body between the first end and the second end, and wherein the grooves are spaced around a circumference of the brushroll and configured to align with the teeth.

21. The vacuum cleaner of claim 20, wherein the brushroll is removable through the aperture in a direction along the axis.

* * * * *